United States Patent [19]

Marchetti

[11] Patent Number: 4,554,042

[45] Date of Patent: Nov. 19, 1985

[54] MACHINE FOR SEALING VARIABLE-HEIGHT PARALLELEPIPEDAL CARTONS

[76] Inventor: Augusto Marchetti, Piazza Sicilia, 7, 20146 Milano, Italy

[21] Appl. No.: 671,001

[22] Filed: Nov. 13, 1984

Related U.S. Application Data

[63] Continuation of Ser. No. 268,488, May 29, 1981, abandoned.

[30] Foreign Application Priority Data

Feb. 13, 1981 [IT] Italy ..... 19710 A/81

[51] Int. Cl.[4] ..... G05G 15/00

[52] U.S. Cl. ..... 156/350; 53/75; 53/137; 156/360; 156/468; 156/486

[58] Field of Search ..... 156/475, 468, 486, 380, 156/360; 53/75, 137

[56] References Cited

U.S. PATENT DOCUMENTS 3,505,774 4/1970 Gidge ..... 53/75 X 4,060,442 11/1977 Marchetti ..... 156/468 X

*Primary Examiner*—David Simmons

*Attorney, Agent, or Firm*—McAulay, Fields, Fisher, Goldstein & Nissen

[57] ABSTRACT

The machine is provided with a carton support and advancement base and a sealing head superimposed to said support base and vertically displaceable with respect to the same. In order to adjust automatically the height of the sealing head to the variable height of the cartons there are provided sensing means mounted on said support base in such a position as to be engaged by the carton bottom to cause the consequent rising of the sealing head from a minimum-height position.

15 Claims, 9 Drawing Figures

MACHINE FOR SEALING VARIABLE-HEIGHT PARALLELEPIPEDAL CARTONS

This is a continuation of application Ser. No. 268,488, filed May 29, 1981, now abandoned.

BACKGROUND OF THE INVENTION

The present invention relates to a machine for sealing variable-height parallelepipedal cartons.

In the Italian Pat. No. 946715 and in the U.S. Pat. No. 4,060,442, both in the name of the same Applicant, there are disclosed sealing machines of the kind including a carton support and advancement base, an upper sealing head superimposed to said support base in a vertically displaceable manner and, usually, a lower sealing head included in said support base.

In order to be able to adjust automatically the vertical position of the upper sealing head to the variable height of the cartons to be sealed, such machines are arranged so that on the inlet end of the upper sealing head, which is normally urged by gravity to a minimum-height position, there is mounted a sensor formed by a sensing lever which can be engaged by the front wall of the incoming cartons. Through a suitable pneumatic device the above cited sensing lever is able, when engaged, to cause the upper sealing head to rise up to a sufficient height for the disengagement of the sensing lever, that is to such a height as to allow the manual or mechanical introduction of the cartons between the support base and the upper sealing head. As a result of the disengagement of the sensing lever, the upper sealing lever stops its rising motion and rests by gravity on the top of the carton, applying therein the closing means, for example a strip of adhesive tape, as the carton is manually or mechanically advanced along the support base.

Such known machines have the only disadvantage that the sensing lever is mounted on the upper sealing head, so that during working it is maintained by the same weight of the sealing head in close proximity to the closed upper flaps of the cartons. It has been possible to verify experimentally that, due to unavoidable flap forming and/or positioning irregularities, this may cause unwanted actuations of the sensing lever and, thus, irregular operations of the sealing head. As a final consequence, the cartons sometimes go out of the machine without being carefully sealed.

Object of the present invention is to realize a sealing machine with automatic adjustment to different height cartons, in which the above said disadvantage does not occur.

According to the invention, such an object is attained by means of a machine, comprising a carton support and advancement base, an upper sealing head superimposed to said support base in a vertically displaceable manner from a minimum-height position, and sensing means engageable by the carton body to cause said sealing head to rise automatically from said minimum-height position to a sufficient height to allow the introduction of the carton between said support base and said sealing head, characterized in that said sensing means are mounted on said support base in such a position as to be engageable by the bottom of the carton.

Otherwise stated, the machine according to the invention therefore provides for the mounting of sensing means no longer on the vertically displaceable sealing head, but on the same carton support base, so that it is the carton bottom which engages said sensing means to cause the sealing head to rise up to the desired height. The result is that the operation of the sealing head is no longer influenced by the more or less regular status of the carton top, while the carton bottom, made regular by the weight of the packed products, in turn causes a correct engagement of the sensing means and, therefore, a constant and regular operation of the machine.

Preferably, said sensing means are constituted by a lever having two sequentially attainable positions, in one of which said rising of the head is caused and in the other of which, subsequently to the introduction of the carton between the support base and the sealing head, the sealing head is caused to go down again on the carton top.

Otherwise, it may be foreseen to use two levers arranged in succession along the carton advancing path.

The features of the present invention will be made more apparent by the following detailed description of non-limiting example in the accompanying drawings. in which:

DETAILED DESCRIPTION

Figure 1:
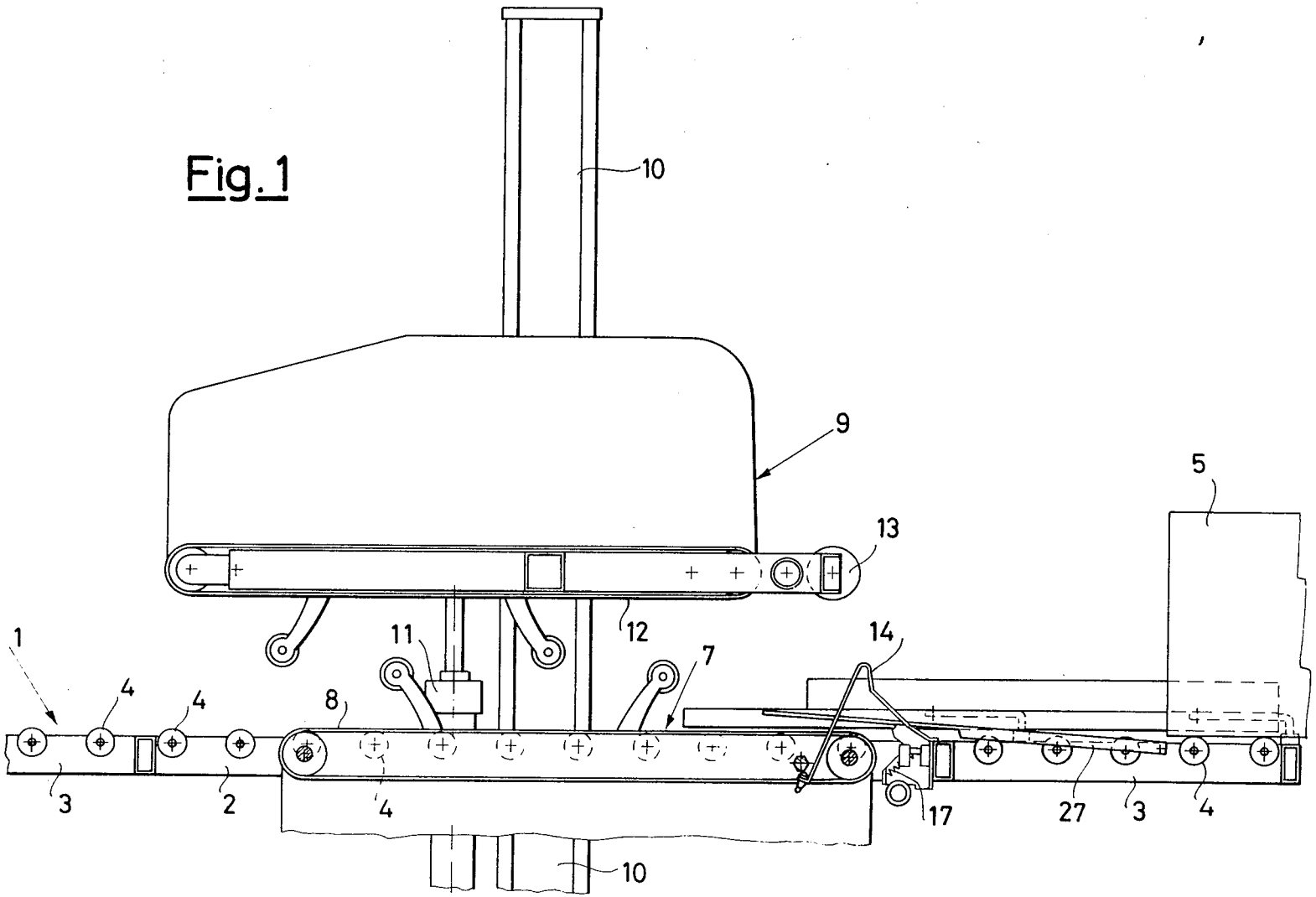
FIG. 1 shows a machine according to the invention in diagrammatic longitudinal section.
Figure 2:
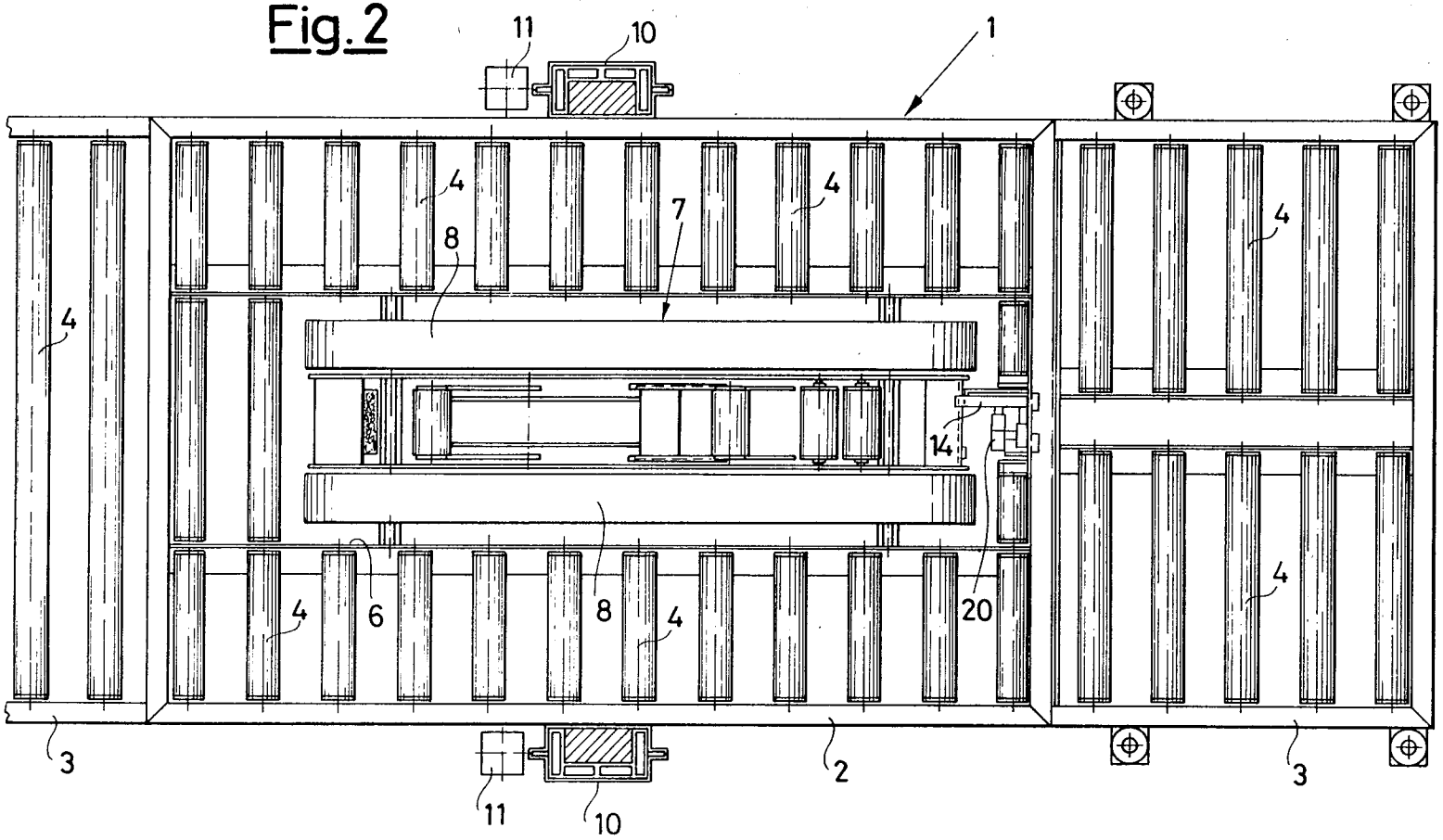
FIG. 2 shows said machine in top plan view with the upper sealing head removed for convenience of drawing.

The sealing machine shown in the drawings comprises a base 1 formed by a rectangular frame 2 with end extensions 3 and by a succession of idle rollers 4 rotatably supported by the said frame and relevant extensions. The rollers 4 define a plane intended for support and advancement of parallelepipedal cartons 5, which have previously been filled and closed but are still to be sealed with adhesive tape on the top and under the bottom thereof.

In a suitable central space 6 of the succession of rollers 4 there is housed a lower sealing head 7, which has the function of applying a strip of sealing adhesive tape along the split which divides the closed lower side flaps of the carton bottom. The structure of said sealing head will not be described in detail herein, since it is of a type well known in the art; it will however be useful to point out that said sealing head comprises a pair of conveying belts 8 which, suitably motorized, are able to engage the bottom of the cartons to cause the advancement thereof (from right to left in FIGS. 1 to 4).

Figure 3:
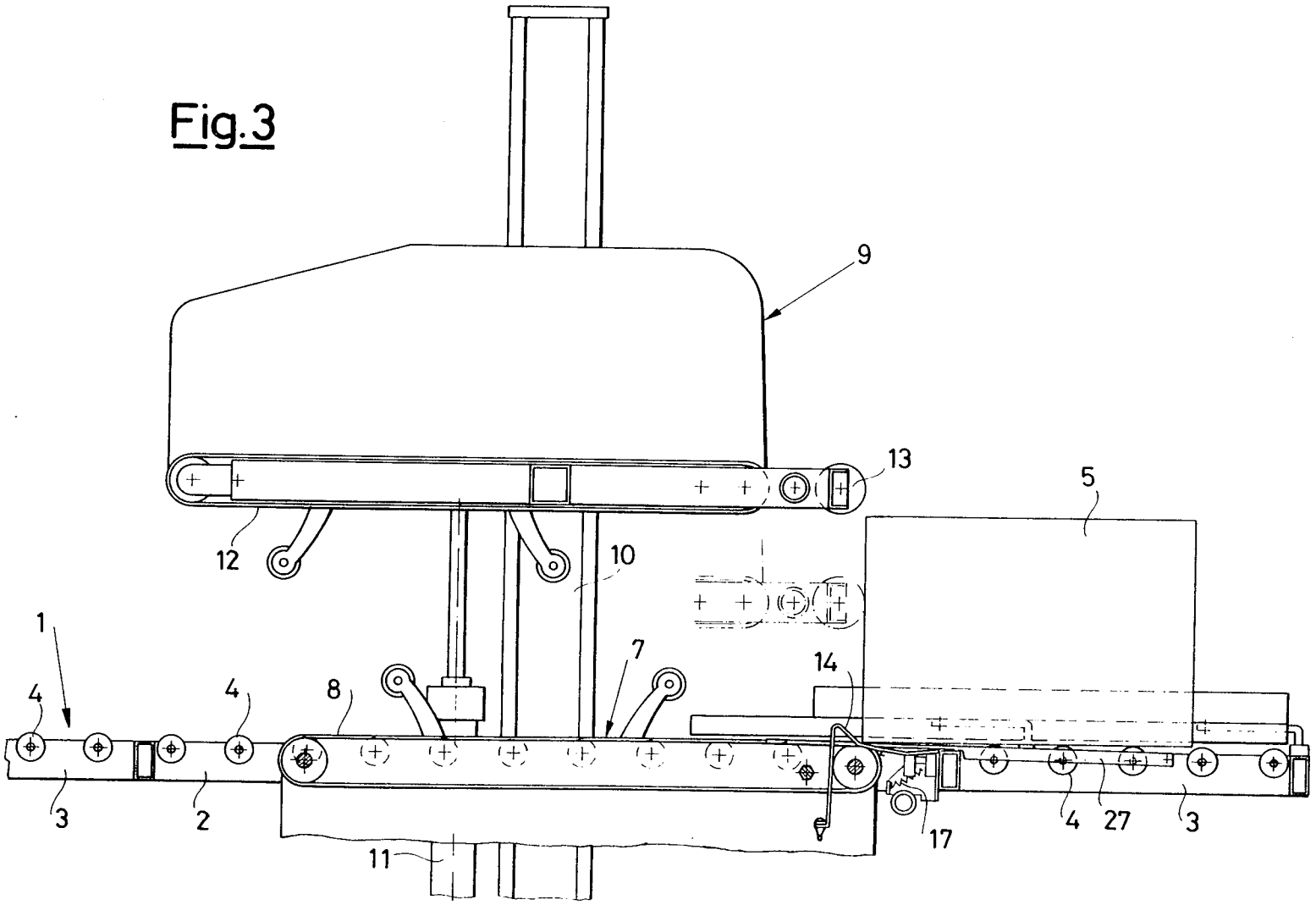
FIG. 3 shows said machine in longitudinal section as in FIG. 1, but in a different working stage.

There is superimposed to the lower sealing head 7 an upper sealing head 9, which is vertically displaceable along two lateral uprights 10 under the effect of its own weight, which urges it to a minimum-height position (FIG. 1), and of a pair of pneumatic cylinders 11 which, when so actuated, are able to raise it up to a desired height (FIG. 3). The upper sealing head 9 will not be described in detail herein either, since it is in turn of a type well known in the art; for the purposes of the present description it will be sufficient to state that the upper head also comprises a pair of motorized conveying belts 12 engageable with the carton top for advancement purposes and further includes at its inlet end a roller (or a pair of aligned rollers) 13, against which the front wall of the carton can abut during the rising of the sealing head 9 (FIG. 3).

Figure 5:
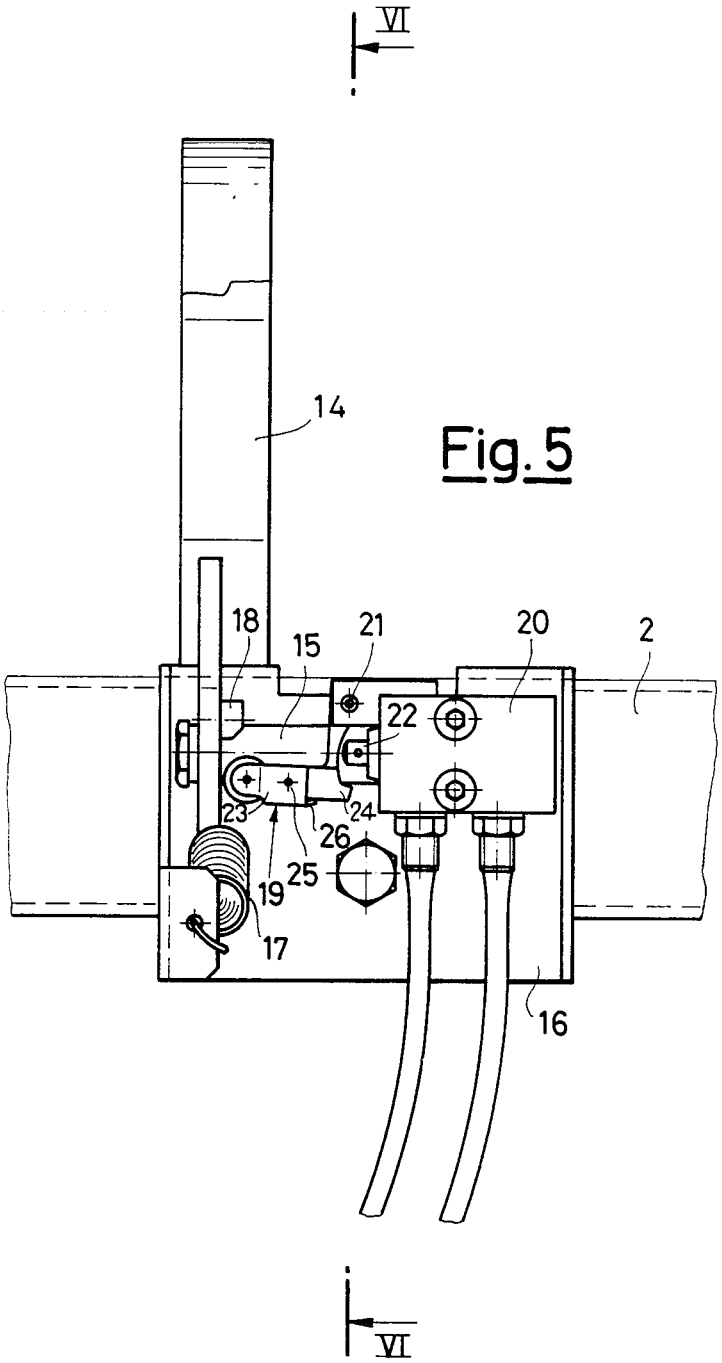
FIG. 5 shows the enlarged detail, at rest, of the sensing means which cause the upper sealing head to rise to adjust the machine to variable-height cartons.
Figure 6:
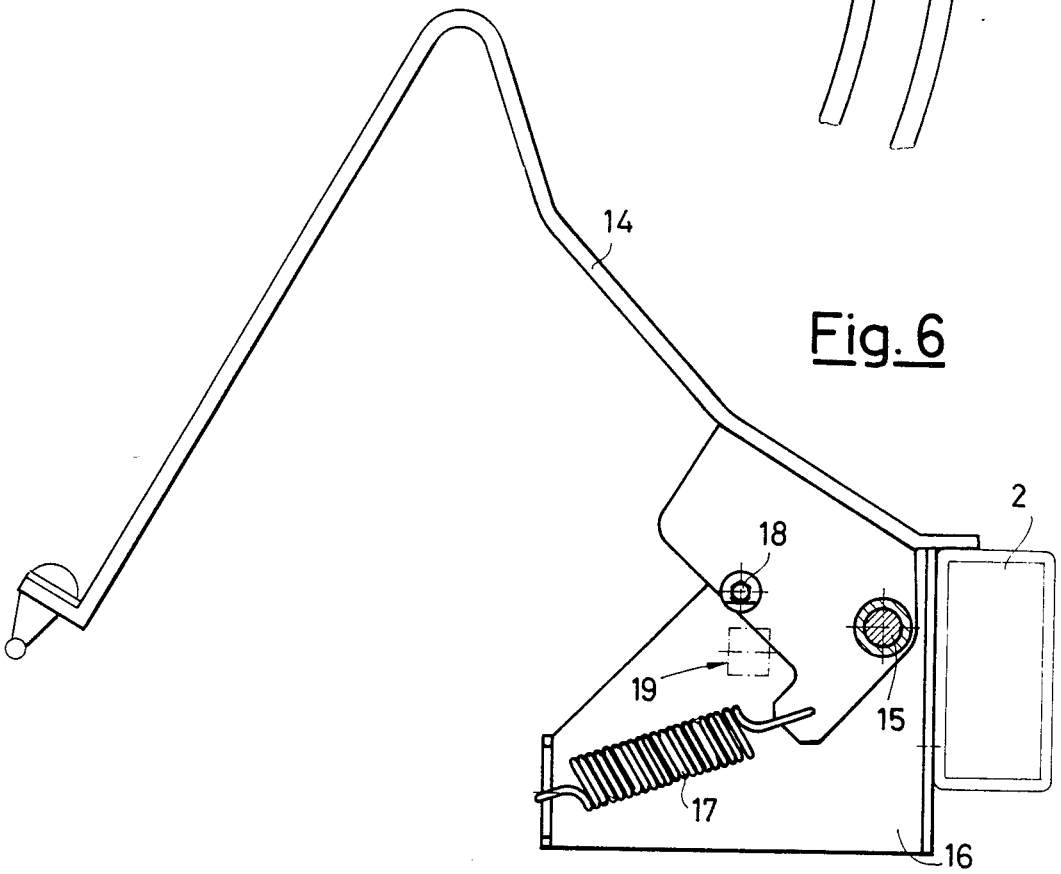
FIG. 6 shows said sensing means in section along the line VI—VI of FIG. 5.

Sensing means arranged along the carton support and advancement plane, just before the roller 13 of the head 9, and suitably fixed to said plane provide for the control of the rising of the upper sealing head 9. Said sensing means are illustrated in detail in FIGS. 5 to 9 and comprise a lever 14 pivoted at 15 on a support member 16 fixed to the base frame 2 and urged by a spring 17 towards a rest position represented in FIGS. 1, 5 and 6; in said position the lever 14 clearly projects above the carton support and advancement plane (FIG. 1).

Figure 4:
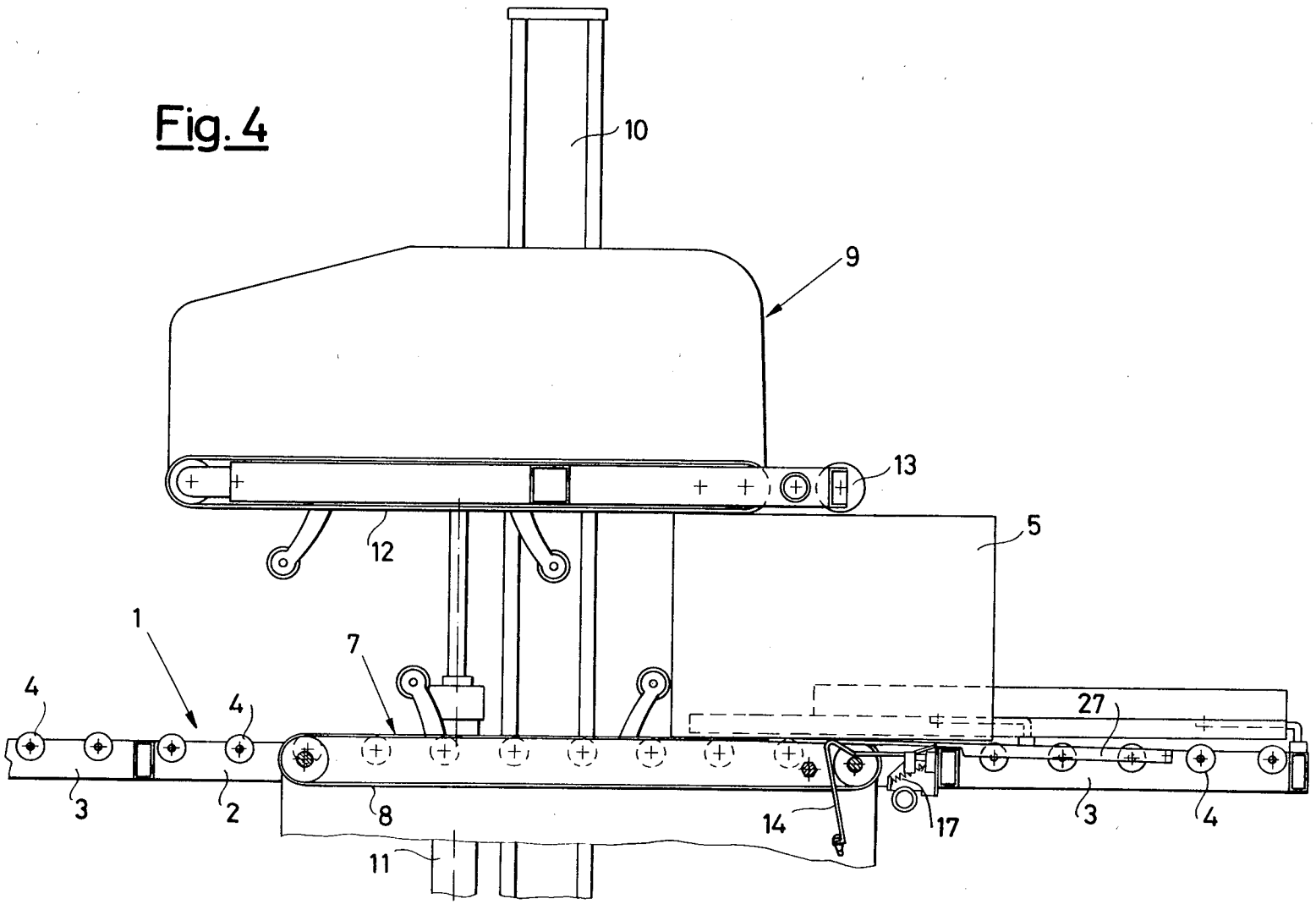
FIG. 4 shows said machine as in FIGS. 1 and 3, but in a different working stage.
Figure 7:
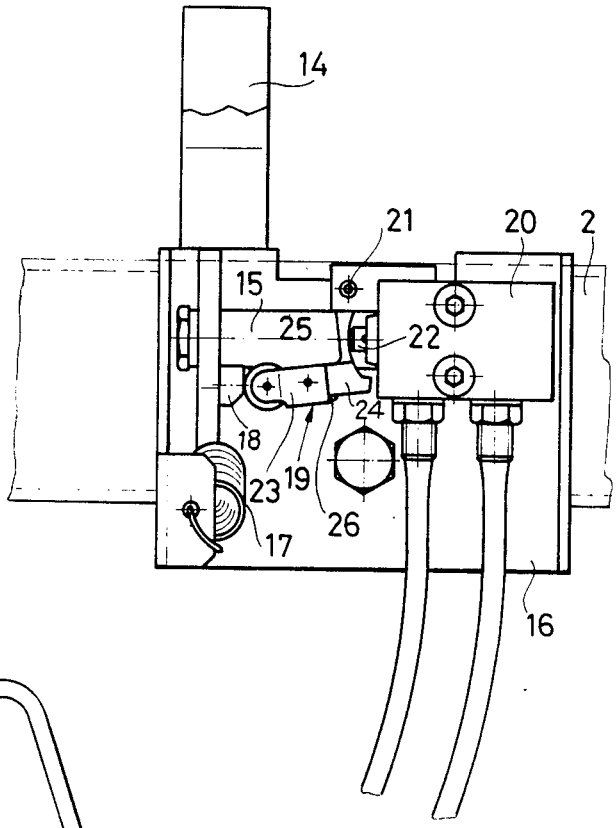
FIGS. 7–9 show said sensing means as in FIG. 5 but in different working conditions.
Figure 8:
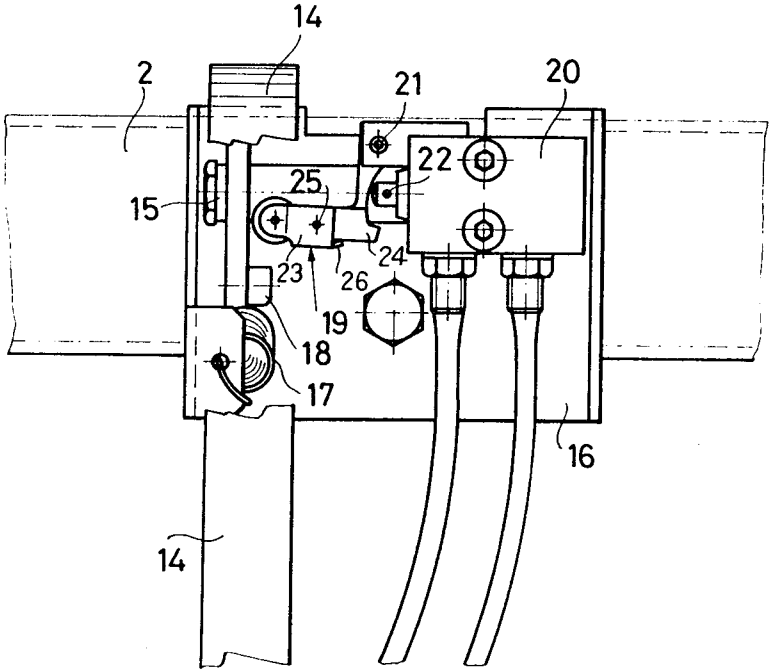

There is fixed to the lever 14 a pawl 18 which, in case of displacement of the same lever from said rest position to the complete-engagement position of FIG. 8 (under the action of the superimposed carton bottom, as shown in FIG. 4), engages in the intermediate position of FIG. 7 (to which the lever is forced by the same carton bottom when the front wall of the same carton abuts against the roller 13 of the upper sealing head 9, as illustrated in FIG. 3) an articulated arm 19 which operates as actuating member for a pneumatic valve 20 destined for the control of the cylinders 11. More precisely, when the lever 14 is in the position of FIG. 7, the pawl 18 causes the arm 19 to rotate about its hinge point 21 (against the action of a suitably arranged spring), thus causing the same arm to thrust the rod 22 of the valve 20 to switch the latter from a rest condition, in which the valve connects to exhaust the lower chambers of the cylinders 11 (and thus allows in turn the sealing head 9 to be maintained by its own weight in the minimum-height position of FIG. 1), to a work condition in which the valve connects said lower chambers of the cylinders 11 to a compressed air supply, thereby allowing the sealing head 9 to rise.

Figure 9:
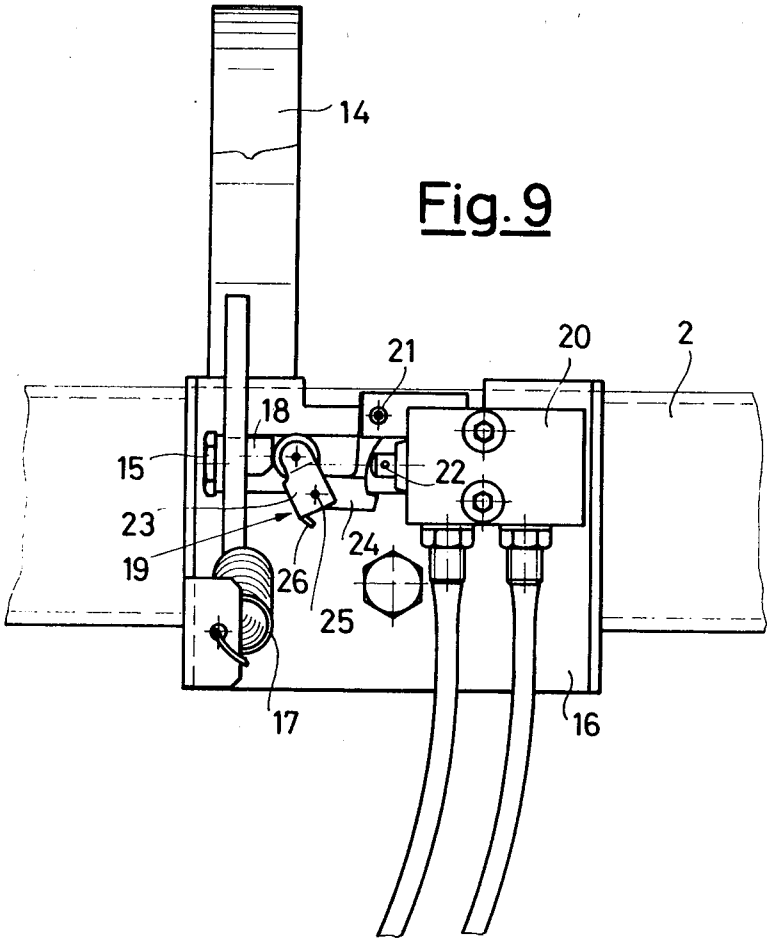

As may be seen from FIG. 9, the articulated arm is actually formed by two pieces 23 and 24, which are pivoted to one another at 25 and are resiliently urged in such a way as to be maintained normally in the aligned position of FIGS. 7 and 8, while being however foldable in the direction illustrated in FIG. 9. On the contrary, any folding in the opposite direction is prevented by a tab 26 of the foldable piece 23, which tab, when the arm is straight, abuts against the adjacent piece 24 (FIGS. 7 and 8). Another lever 27, which can be viewed in FIGS. 1, 3 and 4, has in turn the function of actuating the conveying belts 8 and 12, when said lever is pushed down by the incoming cartons.

The following mode of operation of the machine illustrated in the drawings results from the described arrangement. With the machine at rest, the upper sealing head 9 is kept by its own weight in the minimum-height position of FIG. 1, that is at a height lower than the minimum height of the cartons to be sealed. In this condition, the incoming carton, manually thrusted by the operator or otherwise urged to advance, firstly depresses the lever 27, thus actuating to rotation the conveying belts 8 and 12 of the two sealing heads 7 and 9. The carton stops its advancement against the roller 13 of the upper sealing head 9 (situation illustrated in dash-dot lines in FIG. 3), while depressing partially the lever 14 (suitably shaped with two differently inclined parts) up to bring it to the position of FIG. 7. Through the articulated arm 19 the pawl 18 then causes the switching of the valve 20, which feeds compressed air to the lower chambers of the cylinders 11 with consequent or raising rising of the upper sealing head 9. As soon as the latter has arrived at a height corresponding to that of the carton (situation illustrated in solid lines in FIG. 3), the carton may be introduced between the head 9 and the underlying support plane, thus engaging the conveying belts 8, which convey it forwards, and simultaneously further depressing the lever 14 up to bring it to the position illustrated in FIGS. 4 and 8. The pawl 18 thus releases the arm 19 and the valve 20 is allowed to return to rest, connecting again to exhaust the lower chambers of the cylinders 11. The upper sealing head 9 is therefore left free to rest on the top of the carton, engaging it by means of its conveying belts 12 and applying thereto an upper sealing tape, as well as the lower sealing head 7 provides the carton bottom with a lower sealing tape. When the bottom of the advancing carton disengages the lever 14, the latter goes back to the rest position of FIG. 5, but this does not cause any consequence for the valve 20 and, therefore, for the sealing head 9, since the articulation between the two parts 23 and 24 of the articulated arm 19 allows the pawl 18 to pass without any switching of the valve 20 (FIG. 9). When the carton has left the space between the upper sealing head 9 and the support plane defined by the rollers 4, the head 9 finally returns to the rest position of FIG. 1.

I claim:

1. Machine for sealing variable-height parallelepipedal cartons, comprising:

a carton support and advancing base;

an upper sealing head superimposed to said support base in a vertically displaceable manner from a minimum-height position;

lifting means for lifting said head; and sensing means engageable by the carton body to actuate said lifting means and cause said sealing head to rise automatically from said minimum-height position to a sufficient height to allow the introduction of the carton between said support base and said sealing head, wherein said sensing means are mounted on said support base in such a position as to be engageable by the bottom of the carton and wherein said sensing means are formed in such a way as to include three operative positions comprising an initial rest position and, first and second sequentially attainable working positions, in which said sensing means cause the ascent of the sealing head up to a sufficient height for the introduction of the carton and, respectively, once the introduction has been effected, allow the same head to descend again on the carton top;

said sensing means returning to said initial rest position upon disengagement of said bottom from said carton.

2. Machine according to claim 1, wherein said sensing means comprise a lever having an initial rest position and first and second sequentially attainable working positions, and a valve responsive to said first and second working positions of said lever to actuate and, respectively, deactuate said lifting means for said sealing head.

3. Machine according to claim 1, wherein said sensing means comprise first and second levers arranged in succession along the carton advancement path and respective first and second valves responsive to said first and second levers to actuate and, respectively, deactuate said lifting means for said sealing head.

4. In a machine for sealing variable-height parallelepipedal cartons having a sensing means, a carton support and advancing base, an upper sealing head superimposed to said support base in a vertically displaceable manner from a minimum-height position, and sensing means being engageable by the carton body to cause said sealing head to ascend automatically from said minimum-height position to a sufficient height to allow the introduction of the carton between said support base and said sealing head, wherein the improvement comprises:

said sensing means being mounted on said support base in such a position as to be engageable by the bottom of the carton and wherein said sensing means includes three separately operable positions, an initial rest position; first and second sequentially attainable working positions, said sensing means upon engagement by the bottom of the carton causing the ascent of the sealing head up to a sufficient height for the introduction of the carton and, respectively, once the introduction has been effected, allows the same head to descend again on the carton top, and upon disengagement of said bottom from said carton allows said means to return to said initial rest position.

5. In a machine according to claim 4, wherein said sensing means comprises a lever having an initial rest position and first and second working positions and a valve responsive to said first and second working positions of said lever to actuate and, respectively, deactuate lifting means for said sealing head.

6. In a machine as claimed in claim 4, wherein said sensing means comprises:

a lever pivoted on a support member, said support member being fixed to said support base, and a spring urging said lever to a rest position forming one of said operative positions.

7. In a machine as claimed in claim 6, wherein said sensing means comprise:

a pawl fixed to said lever and an acticulated arm and a valve operated thereby responsive to said first and said second working positions for controlling the rising and the descent of said head.

8. In a machine as claimed in claim 5, said sensing means comprising:

a lever pivoting a support member, said support member being fixed to said support base, and a spring urging said lever to a rest position constituting one of said operative positions.

9. In a machine as claimed in claim 8, a pawl fixed to said lever and an articulated arm and a valve operated thereby responsive to said first and said second working positions for controlling the rising and the descending of said head.

10. A machine as claimed in claim 1, wherein said sensing means comprises:

a lever pivoting a a support member, said support member being fixed to said support base, and a spring urging said lever to a rest position forming one of said operable positions.

11. A machine a claimed in claim 10, including a pawl fixed to said lever, and an articulated arm and a valve operated thereby responsive to said first and said second working positions for controlling the ascent and descent of said head.

12. The machine as claimed in claim 2, including an articulated arm for operating said valve responsive to said first and said second working positions for controlling the ascent and the descent of said head.

13. In a machine as claimed in claim 6, said machine further including a tab, said articulated arm being formed of two sections pivoted to one another, and resiliently urged in such a way as to be maintained normally in an aligned position while being foldable in one direction, with any folding in in the opposite direction being prevented by said tab.

14. The machine according to claim 1, wherein said means for lifting said head includes a pair of pneumatic cylinders.

15. The machine according to claim 2, including a pawl fixed to said lever, and an articulated arm operated by said pawl for operating said valve.

* * * * *